US007992876B2

(12) United States Patent
Aktürk et al.

(10) Patent No.: US 7,992,876 B2
(45) Date of Patent: Aug. 9, 2011

(54) SEALING GASKET FOR FURNACE BODY BUTTON

(75) Inventors: Naim Aktürk, Tekirdag (TR); Sahin Cim, Tekirdag (TR); Nizami Es, Tekirdag (TR); Kasim Yazan, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 434 days.

(21) Appl. No.: 11/920,944

(22) PCT Filed: May 15, 2006

(86) PCT No.: PCT/EP2006/062319

§ 371 (c)(1), (2), (4) Date: Nov. 21, 2007

(87) PCT Pub. No.: WO2006/128790

PCT Pub. Date: Dec. 7, 2006

(65) Prior Publication Data

US 2009/0230631 A1 Sep. 17, 2009

(30) Foreign Application Priority Data

Jun. 3, 2005 (TR) ..... 2005-02100

(51) Int. Cl.
*E21B 3/04* (2006.01)

(52) U.S. Cl. ..... 277/634; 277/635

(58) Field of Classification Search ..... 277/634, 277/635; 174/152 G; 16/2.1, 2.2; 248/56; 74/553

See application file for complete search history.

(56) References Cited

U.S. PATENT DOCUMENTS

| | | | | | |
|---|---|---|---|---|---|
| 2,897,533 | A | * | 8/1959 | Bull et al. | 16/2.1 |
| 3,518,359 | A | * | 6/1970 | Trimble et al. | 174/153 G |
| 4,012,806 | A | * | 3/1977 | Howie, Jr. | 16/441 |
| 4,082,301 | A | * | 4/1978 | Salinger | 277/637 |
| 4,137,602 | A | * | 2/1979 | Klumpp, Jr. | 16/2.1 |
| 4,675,937 | A | * | 6/1987 | Mitomi | 16/2.1 |
| 4,801,040 | A | * | 1/1989 | Kraus | 220/787 |
| 4,959,509 | A | * | 9/1990 | Takeuchi et al. | 277/606 |
| 5,244,175 | A | * | 9/1993 | Frankel | 248/215 |
| 5,739,475 | A | * | 4/1998 | Fujisawa et al. | 174/153 G |
| 5,856,635 | A | * | 1/1999 | Fujisawa et al. | 174/153 G |

(Continued)

FOREIGN PATENT DOCUMENTS

CA 2200375 A * 9/1997

(Continued)

OTHER PUBLICATIONS

International Search Report PCT/EP2006/062319.

*Primary Examiner* — Shane Bomar
*Assistant Examiner* — Robert E Fuller
(74) *Attorney, Agent, or Firm* — James E. Howard; Andre Pallapies

(57) ABSTRACT

A sealing gasket for providing sealing in a mounting gap on a furnace body where a rotating control member is positioned, is located in a mounting opening and includes a sealing wing, in contact with the wall of the body, a retaining member in contact with the outer surface of the furnace body, and at least one bump form extending towards the control member at the continuity of the retaining member and in the direction of the gasket extension for preventing water from reaching to the control member and furnace body.

36 Claims, 1 Drawing Sheet

U.S. PATENT DOCUMENTS

| | | | | |
|---|---|---|---|---|
| 5,929,402 | A | 7/1999 | Charles et al. | |
| 6,051,795 | A * | 4/2000 | Fisher et al. | 174/153 G |
| 6,240,597 | B1 * | 6/2001 | Mochizuki | 16/2.1 |
| 6,339,196 | B1 * | 1/2002 | Uchida | 174/153 G |
| 6,530,692 | B2 * | 3/2003 | Wyer | 384/295 |
| 6,675,439 | B2 * | 1/2004 | Hashimoto | 16/2.1 |

FOREIGN PATENT DOCUMENTS

| | | | |
|---|---|---|---|
| DE | 80 09 481 | U | 9/1980 |
| EP | 0 797 052 | | 9/1997 |
| ES | 2 200 723 | | 3/2004 |
| JP | 59006468 | A * | 1/1984 |

* cited by examiner

SEALING GASKET FOR FURNACE BODY BUTTON

TECHNICAL FIELD

Present invention is related to sealing gaskets, e.g., located in between the buttons and tray of counter-top furnaces.

BACKGROUND

In mounting the buttons that control various parameters in furnaces and similar house appliances onto the devices, there remains a gap between device body and button. This gap basically ensures that the button is rotated freely without any friction. However, this gap may also cause permeation of various liquids into the body through button gap as a result of cleaning operations on device or similar causes.

In order to overcome this shortfall, under-button gaskets were developed. The said applications were disclosed by a patent document no. EP 0 797 052. Although the applications described in the patent above basically prevent permeation of water through the said gaps, they pose a serious problem in terms of assembly and disassembly on furnace tray due to their constructions. Because they lack a part that is introduced into furnace body, or they have such parts that incorporate a section out of body, which is both short and in equal distance. During assembly of a furnace, it is quite problematic to mount such constructions to the button opening from outside of furnace tray.

However currently available sealing gaskets lose their sealing effect when they deform in time due to their flexible materials. In this case it is either impossible or quite difficult to remove and then replace them. Moreover in current applications, the gaskets limit press-rotation of buttons.

In addition to foregoing, one of the important problems is that there are no measures to prevent any foreign substances that advance toward furnace button during cleaning or in case when a meal overflows, from going through the button itself although gasket ensures a sealing with outer body.

SUMMARY

Based on the current state of art, the purpose of this invention is to overcome the disadvantages of current state of art through a novel under-button gasket.

Another purpose of this invention is to provide an under-button gasket construction that can not be removed after assembly thereof, but is able to function even if it comes out of the opening for any reason or the gasket is deformed due to the nature of its material.

Yet another purpose of this invention is to make harder for the gap between furnace and button to contact with a foreign substance thanks to a under-button gasket form having an inclined, water-repellant surface.

In order to achieve these goals, a novel sealing gasket construction was developed, for providing sealing in a button mounting gap on a furnace body where rotating control members are positioned, said sealing gasket being located in the mounting gap via two contacting surfaces thereof, one facing to the button and other one facing to the furnace body.

In a preferred embodiment of this invention, the gasket is characterized by at least one sealing wing, a surface thereof facing to the control member is in contact with the wall of the body at the sealing gasket's tip facing to the furnace body for improving sealing and enabling a mounting from the inside of the body, at least one retaining member, a surface thereof facing to said sealing wing is in contact with the outer surface of the furnace body, and at least one bump form extending towards the control member at the continuity of said retaining member and in the direction of the gasket extension for preventing water from reaching to the control member and furnace body.

In a preferred embodiment of this invention, the said bump shaped gasket extension is an elastic buffer member. Thereby it is possible for gasket to damp any forces from outside.

In a preferred embodiment of this invention, the said bump shaped gasket extension is essentially a quadric to ease bending and elevate toward the edges.

In a preferred arrangement of this invention, the said bump form is one-piece hyperboloid preventing liquid leakage to tips thereof by forming an elevation towards both the furnace body and control member.

In a preferred embodiment of this invention, the sealing gasket comprises at least one inclined surface formed at the tip portion of the retaining member so that wide diameter of the retaining member is passed through the gap with ease when the retaining member is pushed towards the mounting opening from the inner side to the outer side of the furnace body.

In a preferred embodiment of this invention, the sealing gasket is characterized in that the said retaining member essentially comprises silicone. Thereby a suspension activity against foreign impacts increases and manufacturing processes get easier.

In a preferred embodiment of this invention, the section of said hyperboloid surface at the side of furnace body forms the retaining wing.

In a preferred embodiment of this invention, the sealing gasket is characterized by plurality of feeders embodied on the hyperboloid surface for facilitating the production of the said retaining wing by injection molding.

In a preferred embodiment of this invention, the proportion of the width of the said retaining wing to the width of the mounting opening is essentially 1.2 for mounting the said retaining wing to furnace body with ease. Thereby mounting takes place easily and gasket is prevented from getting out of its seat.

DETAILED DESCRIPTION OF TECHNOLOGY

Figure 1A:
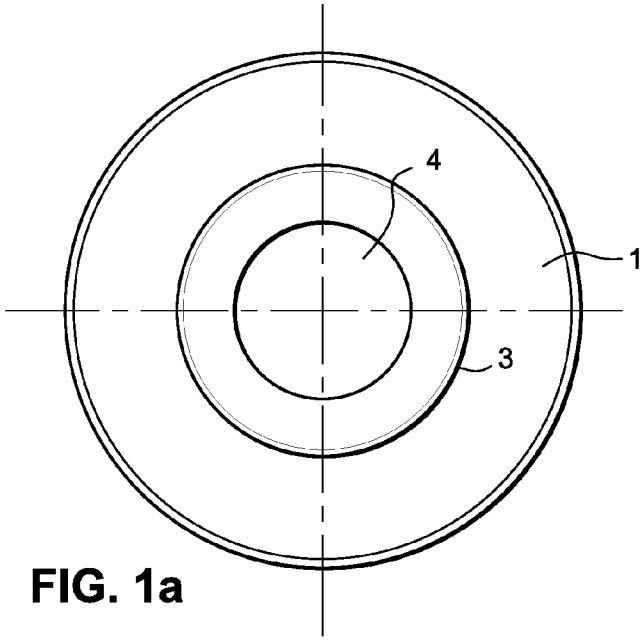
FIG. 1*a* is a front view of a representative embodiment of this invention.
Figure 1B:
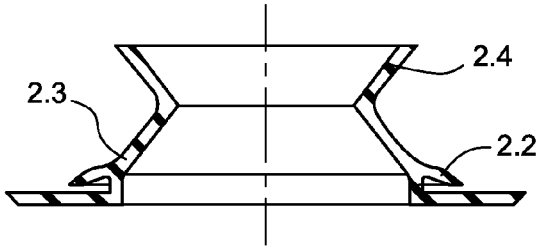
FIG. 1*b* is a top view of the embodiment shown is FIG. 1*a*.
Figure 1C:
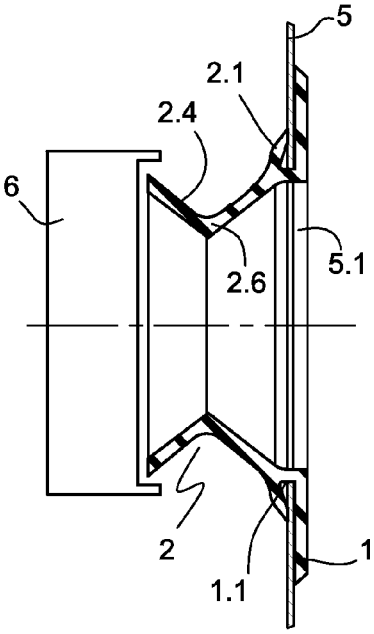
FIG. 1*c* is a left-hand view of the embodiment shown is FIG. 1*a*.
Figure 1D:
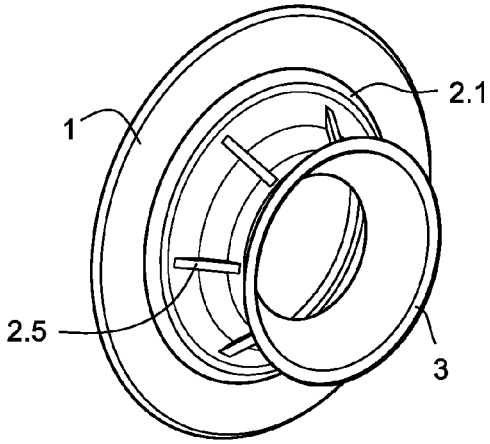
FIG. 1*d* is a perspective view of the embodiment shown is FIG. 1*a*.

In the embodiment of this invention as shown in figures, gasket (1,2,3,4) is manufactured in single piece from silicon rubber material via injection. An annular valve passage opening (4) is formed longitudinally at the center of cylindrical gasket for a valve (not shown in figures) from furnace body (5) to pass through.

Gasket comprises respectively a sealing wing (1) substantially in the form of a large annular plate, a seat (1.1) which is a cylindrical extension extending perpendicularly to the wing (1), as followed by a buffer extension (2) in the form of a hyperboloid, and a button contact surface (3) formed by the said buffer extension (2).

Buffer extension (2) is formed by combining a body inclined surface (2.3) with an angle of 37.5 degree relative to an axis A and extending beyond the retaining member (2.1) and a button inclined surface (2.4) with an angle of 37.5 degree relative to axis A opposite to the body inclined surface, with a radius given thereto. Free tip of button inclined surface (2.4) forms the button contact surface (3).

There is an inclination at the tip of retaining member (2.1) in the direction of extension of the sealing wing (1) in order to facilitate the passage through mounting aperture (5.1) of furnace body (5). In addition to this, there is a member passage inclination (2.2) at the tip of member (2.1) in such a way to narrow the cross-section. The most extreme end of member (2.1) has a small radius.

There are six feeders (2.5) in the form of a fine projection that extend along the inclination in order to increase the strength of buffer extension (2) both during production and against outer impacts. The construction described above allows that the gasket is advanced to the furnace mounting aperture (5.1) from within the furnace (5) and thereby a large sealing wing (1) contacts with the furnace wall (5). During mounting, the retaining member (2.1), which is wider than the channel thanks to the member passage inclination (2.2), bends easily and this ensures that the furnace wall (5) fits well into the seat (1.1).

Also the pressure exerted on the tip of body inclined surface (2.3) by squeezing the buffer extension (2) from button contact surface (3) with the sealing wing (1), rotates the flexible material in opposite direction, then the retaining member (2.1) opens the seat (1.1) toward the mounting aperture and this leads to an easier assembly.

With the current construction, the hyperboloid form of buffer extension (2) with two passage inclinations (2.2, 2.3) in a way to form a bump, ensures that any foreign substances that may appear on the buffer extension (2) after mounting of gasket due to factors such as cleaning, would advance in the direction of a curve (2.6) and be held away from the inside of button or furnace button mounting aperture (5.1).

This invention is not limited to the illustrative embodiments described herein. Any alternative constructions that may be performed by the persons skilled in the art based on the basic principles of this invention as given in the scope of claims, shall mean an infringement to the invention.

The invention claimed is:

1. A sealing gasket for providing sealing in a mounting gap on a furnace body where a rotating control member is positioned for rotation about an axis, the sealing gasket comprising:

a.) at least one sealing wing, a surface thereof adapted to contact an inner surface of the furnace body to seal and enable mounting from inside of the furnace body, b.) at least one retaining member, a surface thereof facing to the sealing wing and adapted to be in contact with an outer surface of the furnace body, c.) a cylindrical extension to connect the sealing wing to the retaining member at their proximal ends, the cylindrical extension having an outer surface adapted to face a rim of a mounting opening though the furnace body, d.) a body inclined surface extending from an intersection between the cylindrical extension and the retaining member and inclined from the intersection towards the axis, and e.) a button inclined surface formed as an extension of the body inclined surface and being inclined away from the axis to prevent water from reaching to the control member and furnace body, wherein the button inclined surface terminates at an open end that includes a button surface to engage with a button associated with the control member.

2. The sealing gasket according to claim 1, wherein the button inclined surface is an elastic buffer member.

3. The sealing gasket according to claim 1, wherein the button inclined surface is essentially a quadric.

4. The sealing gasket according to claim 3, wherein the body inclined surface and the button inclined surface together form a one-piece hyperboloid preventing liquid leakage to tips thereof by forming an elevation towards both the furnace body and control member in use.

5. The sealing gasket according to claim 4, wherein a part of the hyperboloid surface which is located at the outer surface of the furnace body forms the retaining member.

6. The sealing gasket according to claim 5 and further comprising a plurality of feeders provided on the hyperboloid surface for facilitating the production of the retaining member by injection molding.

7. The sealing gasket according to claim 1, further comprising at least one inclined surface formed at the tip portion of the retaining member so that a wide diameter of the retaining member, in use, is passed through the mounting opening when the retaining member is pushed towards the mounting opening from the inner side to the outer side of the furnace body.

8. The sealing gasket according to claim 1, wherein the retaining member essentially comprises silicone.

9. The sealing gasket according to claim 1, wherein the proportion of the diameter of the retaining member to the width of the mounting opening is essentially 1.2.

10. The sealing gasket according to claim 1, including only one said body inclined surface and only one said button inclined surface.

11. The sealing gasket according to claim 1, wherein the button inclined surface and the body inclined surface intersect at a restriction.

12. The sealing gasket according to claim 11, wherein the open end has a diameter that is greater than a diameter of the restriction.

13. A sealing gasket for inhibiting movement of a substance at an interface between a hand manipulable component of an appliance and a mount structure on which the hand manipulable component is mounted, the sealing gasket comprising:

a.) a sealing body that extends through an aperture formed by a rim in a mount structure of an appliance, the aperture of the mount structure having an aperture axis and a radial width as measured perpendicularly to the aperture axis such that a hand manipulable component for setting an operational instruction for the appliance can extend through the aperture with sufficient free play to permit the hand manipulable component to be moved angularly about the aperture axis with an out-facing portion of the sealing body being located on an out-facing side of the mount structure and an in-facing portion of the sealing body being located on an in-facing side of the mount structure that is oppositely facing to the out-facing side of the mount structure, the sealing body having an out-facing portion, an in-facing portion, and a mid portion that is axially intermediate the out-facing portion of the sealing body and the in-facing portion of the sealing body;

b.) at least one sealing projection extending radially outwardly from the in-facing portion of the sealing body and in contact with an in-facing side of the mount structure;

c.) at least one retaining member extending radially outwardly from the sealing body and in contact with an out-facing side of the mount structure, the sealing body having a radial constriction surface axially intermediate the out-facing portion of the sealing body and the mid portion of the sealing body, the radial constriction surface extending along at least a portion of a circumference of the sealing body and being at a smaller radial spacing from the aperture axis than the out-facing portion of the sealing body and the mid portion of the sealing body, the radial constriction surface adapted to inhibiting the movement of a substance along the sealing body in a direction from the mid portion of the sealing body toward the out-facing portion of the sealing body; and (d.) a cylindrical extension to connect the sealing projection to the retaining member at their proximal ends, the cylindrical extension having an outer surface adapted to face the aperture of the mount structure, wherein the radial constriction surface defines a constriction formed by a body inclined surface extending from the cylindrical extension towards the axis, and a button inclined surface that extends from the body inclined surface and outwardly flares away from the axis, wherein the button inclined surface terminates in an open end including a button surface to engage the hand manipulable component, the open end with the button contact surface having a diameter which is greater than a diameter of the constriction.

14. The sealing gasket according to claim 13, wherein the body inclined surface and the button inclined surface form an elastic buffer member.

15. The sealing gasket according to claim 13, wherein the sealing body has a substantially quadric configuration.

16. The sealing gasket according to claim 15, wherein the sealing body is formed as a one-piece hyperboloid that inhibits movement of a liquid substance via its elevational portions that extend towards both the appliance and the hand manipulable component.

17. The sealing gasket according to claim 16, wherein a portion of the hyperboloid surface that is located at a side toward the mount structure forms the retaining member.

18. The sealing gasket according to claim 17 and further comprising a plurality of feeders provided on the hyperboloid surface for facilitating the production of the retaining member via injection molding.

19. The sealing gasket according to claim 13 and further comprising at least one inclined surface formed at a tip portion of the retaining member such that the retaining member can pass through a gap delimited between the hand manipulable component and the mount structure at the aperture when the retaining member is pushed through the aperture of the mount structure in a direction from the in-facing side of the mount structure toward the out-facing side of the mount structure.

20. The sealing gasket according to claim 13, wherein the retaining member is formed of silicone.

21. The sealing gasket according to claim 13, wherein the proportion of the width of the retaining member to the width of the aperture in the mount structure is substantially 1.2.

22. A home appliance comprising:

a furnace body;

an aperture provided through the body;

a control member positioned adjacent the aperture to control one or more parameters of the home appliance; and the sealing gasket according to claim 1.

23. An apparatus comprising:

a rotating control member; and the sealing gasket of claim 1.

24. The apparatus according to claim 23, wherein the rotating control member is a button and the button has a diameter larger than the diameter of the button contact surface.

25. The apparatus according to claim 24, wherein the button includes a flanged outer perimeter to circumscribe the open end of the button inclined surface.

26. A sealing gasket for providing sealing in a mounting gap on a furnace body where a rotating control member is positioned for rotation about an axis, the sealing gasket comprising:

a.) at least one sealing wing, a surface thereof adapted to contact an inner surface of the furnace body to seal and enable mounting from inside of the furnace body, b.) at least one retaining member, a surface thereof facing to the sealing wing and adapted to be in contact with an outer surface of the furnace body, c.) a cylindrical extension to connect the sealing wing to the retaining member at their proximal ends, the cylindrical extension having an outer surface adapted to face a rim of a mounting opening though the furnace body, and d.) a buffer extension consisting of a single body inclined surface and a single button inclined surface, the body inclined surface extending from the cylindrical extension and towards the axis, the button inclined surface extending from the body inclined surface and away from the axis, the button inclined surface terminating at an open end.

27. The sealing gasket according to claim 26, wherein the open end has a diameter which is greater than a constricted diameter of the buffer extension where the body inclined surface and the button inclined surface intersect.

28. A home appliance comprising:

a button to control one or more parameters of the home appliance, and the gasket of claim 26.

29. A sealing gasket for providing sealing in a mounting gap on a furnace body where a rotating control member is positioned for rotation about an axis, the sealing gasket consisting of:

a.) a sealing wing, a surface thereof adapted to contact an inner surface of the furnace body to seal and enable mounting from inside of the furnace body, b.) a retaining member, a surface thereof facing to the sealing wing and adapted to be in contact with an outer surface of the furnace body, c.) a cylindrical extension to connect the sealing wing to the retaining member at their proximal ends, the cylindrical extension having an outer surface adapted to face a rim of a mounting opening though the furnace body, d.) a body inclined surface extending from an intersection between the cylindrical extension and the retaining member and inclined from the intersection towards the axis, and e.) a button inclined surface formed as an extension of the body inclined surface and being inclined away from the axis to prevent water from reaching to the control member and furnace body.

30. The sealing gasket according to claim 29, wherein the button inclined surface is an elastic buffer member.

31. The sealing gasket according to claim 29, wherein the button inclined surface is essentially a quadric.

32. The sealing gasket according to claim 31, wherein the body inclined surface and the button inclined surface together form a one-piece hyperboloid preventing liquid leakage to tips thereof by forming an elevation towards both the furnace body and control member in use.

33. The sealing gasket according to claim 32, wherein a part of the hyperboloid surface which is located at the outer surface of the furnace body forms the retaining member.

34. The sealing gasket according to claim 29, wherein a wide diameter of the retaining member is installed through the mounting opening when the retaining member is pushed towards the mounting opening from the inner side to the outer side of the furnace body.

35. The sealing gasket according to claim 29, wherein the retaining member essentially comprises silicone.

36. The sealing gasket according to claim 29, wherein the proportion of the diameter of the retaining member to the width of the mounting opening is essentially 1.2.

* * * * *